US005608693A

United States Patent [19]

Richards

[11] Patent Number: 5,608,693

[45] Date of Patent: Mar. 4, 1997

[54] NON-LINEAR VIBRATION DEVICE

[76] Inventor: Jeffrey Richards, 1801 E. Tropicana, #9, Las Vegas, Nev. 89119

[21] Appl. No.: 57,885

[22] Filed: May 7, 1993

[51] Int. Cl.[6] ..... G04B 47/00; G04B 3/00; G04D 3/00; B01F 11/00

[52] U.S. Cl. ..... 368/10; 368/206; 81/7.5; 366/114

[58] Field of Search ..... 368/10, 206–213; 73/6; 81/7.5; 366/108–114

[56] References Cited

U.S. PATENT DOCUMENTS

| | | | |
|---|---|---|---|
| 443,695 | 12/1890 | Copeland . | |
| 2,247,978 | 7/1941 | Van Arkel . | |
| 2,863,345 | 12/1958 | Fiechter | 81/7.5 |
| 2,917,955 | 12/1959 | Leger | 81/7.5 |
| 2,926,519 | 3/1960 | Setterberg | 73/6 |
| 3,291,458 | 12/1966 | Hamm . | |
| 3,620,007 | 11/1971 | Keaffman | 58/80 |
| 3,861,061 | 1/1975 | Ross . | |
| 4,057,958 | 11/1977 | Wunth | 58/82 |

*Primary Examiner*—Vit W. Miska
*Attorney, Agent, or Firm*—Ellen C. Childress

[57] ABSTRACT

An apparatus provides accented vibrations to an object and has a means for elastically suspending said object and at least one disengaging displacement means. The application of current interest is for winding a self-winding mechanical wrist watch during intervals when not worn on the wrist so it will not run down and stop. The apparatus has an enclosure and a holder to accept and position a self-winding watch which is periodically set in motion to simulate wrist action. The holder, within the enclosure, is mounted on springs and driven by a low rpm gearmotor which alternately pushes and releases; then pulls and releases so as to give a sharp acceleration in two or more directions. This action increases effectiveness of the apparatus in winding watches in different positions. The motion produced has other applications such as in testing other motion sensitive equipment or in producing unique patterns of mixing.

20 Claims, 5 Drawing Sheets

FIG. 3
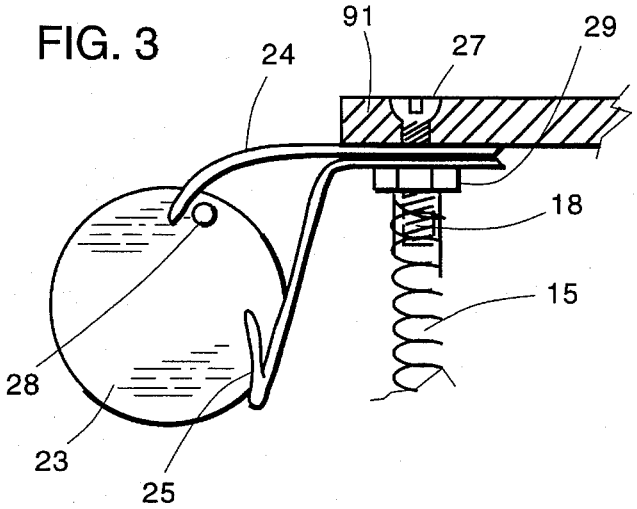
FIG. 4
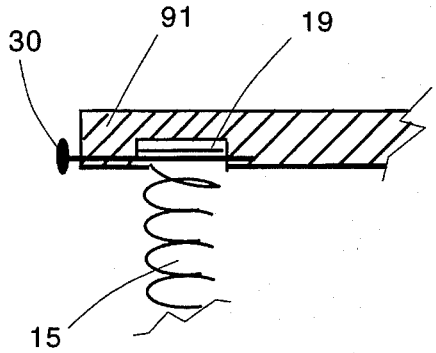
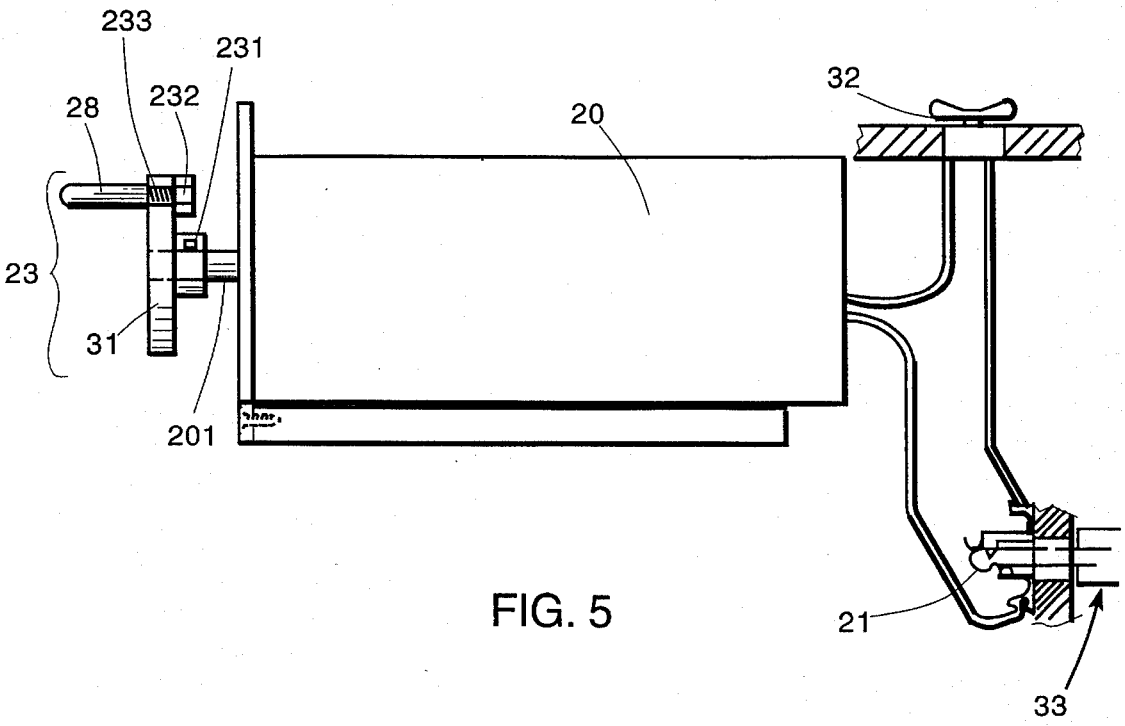
FIG. 5

FIG. 9a
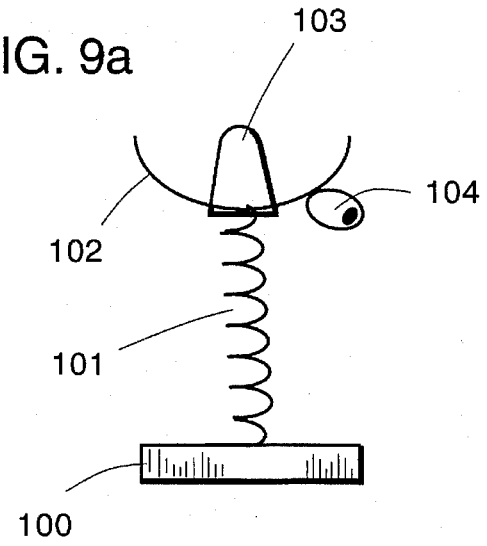
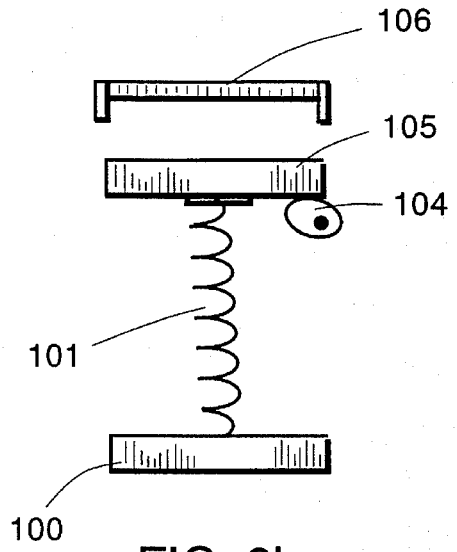
FIG. 9b
FIG. 9c
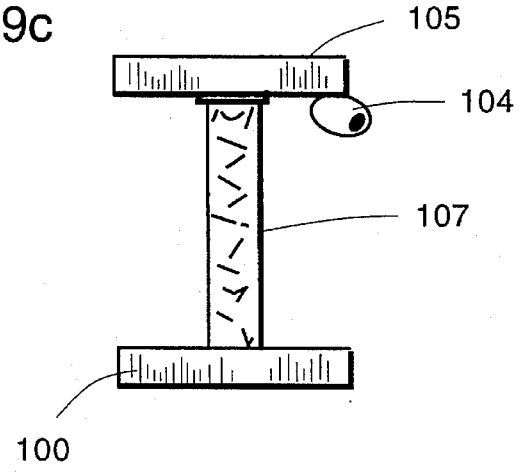

NON-LINEAR VIBRATION DEVICE

FIELD OF INVENTION

The invention relates to an apparatus for producing non-linear large excursion accented vibrations.

BACKGROUND

A large percentage of watches currently manufactured are of the self-winding type. These watches require a threshold amount of daily physical movement in order to keep them running. If such a watch is not worn for a period of time, it will stop running and require resetting. For elaborate watches, resetting can be an ordeal. Further, some people have more than one watch of this type and any watch not being worn may run down before the owner decides to wear it again. If a practical device for winding were available the watch (or watches) not currently in use would simply be placed into the watch winding apparatus which could keep them running indefinitely. When the user chooses to switch watches, the dormant one would already be running and keeping accurate time, and is simply placed on the wrist. The watch being removed from the wrist may be placed into the watch winding apparatus until its next use.

A number of approaches to watch winders have included an apparatus for simulating the motion of the wearer's wrist. For example, U.S. Pat. No. 4,057,958 incorporated herein by reference, entitled "Watch Winder" and issued to Thomas Wuntch, Nov. 15, 1977 discloses a device primarily for home use which accepts a single watch on a mandrel which is rotated coincident with the axis of rotation of the internal self-winding rotor of the watch. The inventor claims an improvement over U.S. Pat. No. 3,620,007, incorporated herein by reference, entitled "Watch Winding Apparatus" and issued to Robert C. Kauffman on Nov. 16, 1971, in that the relationship of the axis of rotation of the stem of the internal winding rotor of the watch to the support shaft of the winding apparatus is generally orthogonal and does not maximize efficiency in turning rotation of the support shaft of the apparatus into rotation of the winding rotor of the watch.

U.S. Pat. No. 2,863,345 by Rene A. Fiechter (Watch Winding Machine) and U.S. Pat. No. 2,917,955 by John L. Leger (Testing Device for Self Winding Mechanism) disclose devices for manufacturers or jewelers who need to wind many watches simultaneously. While the Leger patent shows a device which more closely simulates normal arm motion (alternately accelerating and decelerating), it and the Fiechter device use mechanisms which are complex, bulky and too expensive for home use.

There is a need for an apparatus which avoids prior problems by providing effective winding motion in a number of orientations, more closely simulating irregular and accented movements of the arm, involving a simple mechanism which is economical to produce and maintain, and is efficient providing a full day's winding in less than three hours.

SUMMARY OF THE INVENTION

The invention responds a need for a device to mimic motion of the human arm and in particular produce a motion which would provide automatic winding of a mechanical self-winding wrist watch. The resulting invention is suited for home use functionally and aesthetically. It can be housed in a covered jewelry-type box. It is believed that this device would be useful in testing other motion sensitive equipment or sensors and/or as a novel mixing device, since motions of the platform are complex.

The invention provides a method and apparatus for producing an accented shaking motion. It comprises a means for elastically suspending a holding device so that an object placed in the holding device is subject to perturbations. These perturbations are produced through loose, eccentric coupling with a motor having a low rpm shaft and attached cam-like mechanism. The elastically suspended holding device may be in an enclosure which also houses certain control and linkage devices and an electric motor. The suspended holding device is subject to various movements which will wind a self-winding wrist watch not being worn. By placing a self-winding watch in this device, the fully wound-up watch may continue to run and thus keep time and maintain day/date sequence if so equipped, and also to retard congealment of oil that occurs when a watch is idle for an extended time.

One version of the invention involves an elastically mounted platform which is alternately pushed and released and pulled and released by an eccentric coupling to an electric motor. The platform for the watch winding function is equipped in one instance with a cup-like container (or containers) which help orient the watch for the most favorable action. In other instances, the platform of the holding device may consist of clamps or straps. The driving motor may be battery powered or powered from line current. It may operate at low or high voltage and either A.C. or D.C. Rotation speed is between 5 and 60 rpm although slower or faster could be used.

A mechanism is provided whereby the holding device is slowly pulled or pushed and then released. Spring action snaps the holding device back in the opposite direction providing acceleration and deceleration motion characteristic of the arm movement. An alternate mechanism for periodically engaging and disengaging the holding device is also disclosed.

The platform containing the holding device is loosely arranged within the enclosure to de-couple motion of the platform from the enclosure. The enclosure also provides varying degrees of noise isolation depending on materials used. In one form it includes special feet to absorb lateral motion so the enclosure will not "walk" across the surface it rests upon.

The apparatus of the present invention may be useful in several applications. It may be mounted in a watch box to be purchased separately by the owner of the watch or supplied with new watches by the manufacturer. Moreover, the platform holding device can be made larger in order to accommodate many watches or motion-sensitive devices simultaneously. It is readily appreciated that this device is useful in situations where it is desirable to keep a self-winding wrist watch wound up and running during periods when it is not actually being worn. It is further obvious that the device may be used to provide continuous or intermittent motion which can be used in testing motion sensitive devices including security devices, transducers, electronic components, displays and others. The novel nature of the motion of the platform could also serve as basis for novel mixing devices such as for multi-colored displays.

BRIEF DESCRIPTION OF THE DRAWINGS

FIG. 3 is an exploded, fragmentary view of one embodiment of the push/pull coupling connection between motor eccentric and platform catch incorporated into the apparatus of FIG. 1.

FIG. 4 is a detailed view of one method for fastening springs to platform and housing as in FIG. 2.

FIG. 5 is a detailed side view of gear motor and eccentric coupling piece of FIG. 2 with electrical wiring.

FIG. 9*a*, 9*b* and 9*c* are views of simplified elastically suspended platforms and holding devices.

DETAILED DESCRIPTION

Figure 1:
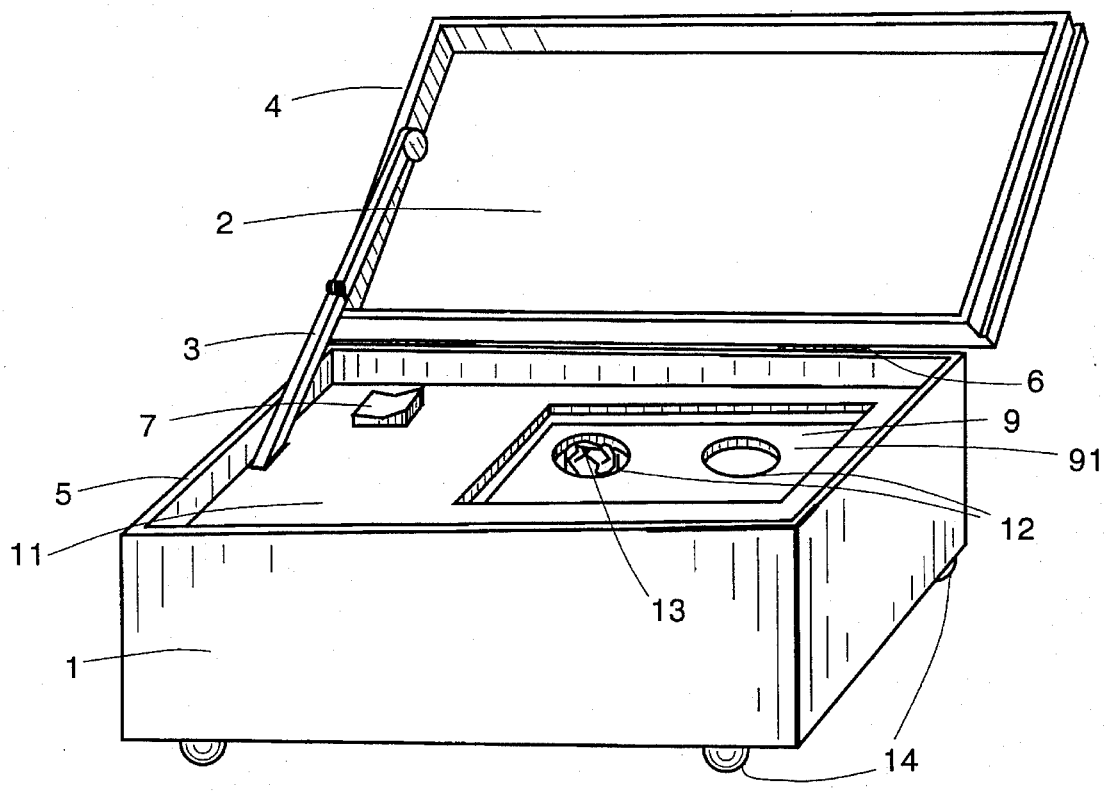
FIG. 1 is a perspective front view of one embodiment of a watch winding apparatus constructed in accordance with the present invention, housing a watch in a jewelry-type box.

FIGS. 1 through 5, show an embodiment of a vibratory platform for use as a watch winder 10, positioned in an enclosure 1 similar to a jewelry storage box. The enclosure 1 is comprised of a lid 2 having lid retaining support arm 3. The lid has an inner lip 4 which fits inside an outer lip 5 of the enclosure 1. One or more hinges 6 connects the lid 2 with the enclosure 1. An on-off switch 7 is also shown. The elastically suspended holding device 9 is in the form of a moving platform 91 sunken below the top frame member 11 and mechanically separate from it. Platform 91 has two holes in it for accepting positioning cups 12. In one positioning cup is a self-winding watch 13. Enclosure 1 has rubber feet 14 or similar devices to prevent "walking" of the apparatus across the surface it rests upon when operating.

Figure 2:
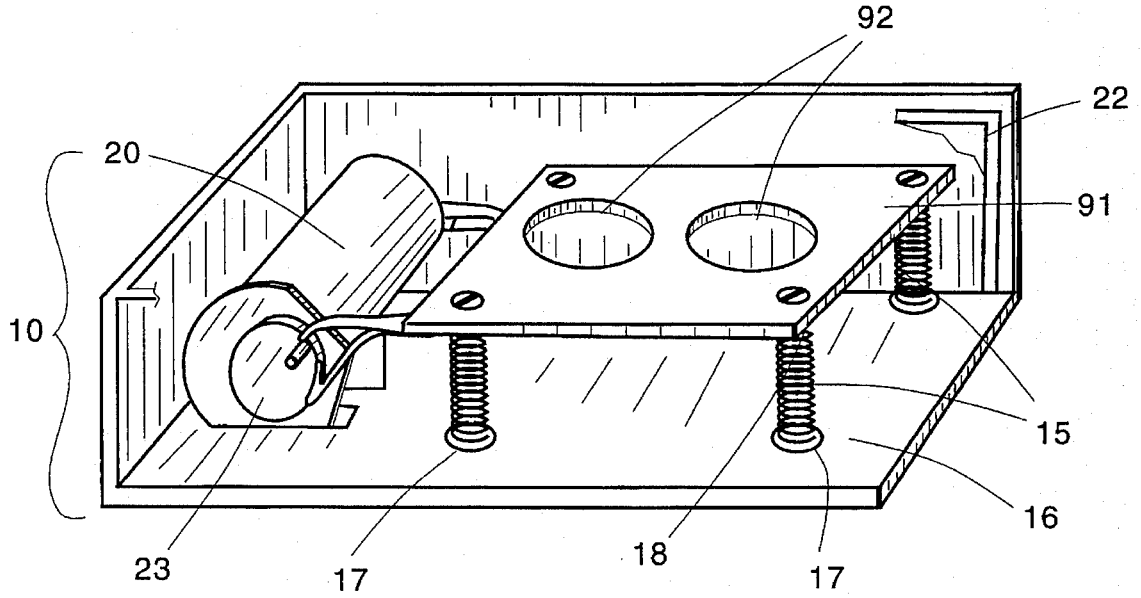
FIG. 2 is cut-away view of the apparatus of FIG. 1, showing the spring mounted holding device platform, a coupling apparatus and the driver motor.

Referring now to FIG. 2, there is more clearly shown the operating mechanism within enclosure 1. Platform 91 consists of a plate with two holes of 4 to 9 centimeters diameter. The platform is mounted with elastic devices, in this case four compression springs 15 at each corner which in turn are affixed to the base of the enclosure 16. The springs are secured to the base in one instance by cementing them into four wells 17 in the base plate. Such wells are approximately the same diameter as the springs. On the top springs may be fixed around dowels 18 (of metal, wood or plastic) and/or inserted into shallow wells 19 on the under side of the platform (see FIG. 4).

Item 20 is motor having a low rpm output, in this instance a 24 volt D.C. gearmotor powered from a receptacle 21 which receives a plug 33 (see FIG. 5) from an AC/DC adapter plugged into a 120 V AC wall outlet. The device could also operate off line voltage directly or a reduced line voltage by using an external or built in power converter. A motor could be used which is AC or DC. In the latter instance it could be battery powered although motor power requirements argue against this for home watch winding.

The walls of the enclosure may be lined with a sound absorbing material 22 such as a low density foam to provide for sound deadening of the motor, coupling and spring noise.

The platform can be constrained to primarily left-right motions by placing two opposing edges in a channel. This has merit in some test situations. Likewise, the elastic devices could be placed perpendicular to the present placement.

Referring now to FIG. 3, there is shown a diagrammatic drawing of the coupling mechanism between the apparatus 23 mounted on the motor shaft and the elastically suspended platform 91. The coupling mechanism has a top hook 24 for pulling and a bottom hook 25 for pushing platform 91. The length and curvature of each hook has been determined to be very important for effective engagement and disengagement. In particular, the radius of curvature of hook 24 at its outer edge is in between 1 and 4 cm and the radius of curvature of the outer terminal portion of bottom hook 25 is in the range of 3 to 6 cm. Each hook is bolted 27 or otherwise firmly affixed to the platform 91.

As the motor 20 turns the shaft apparatus 23, a pin 28 alternately engages and disengages the top 24 and bottom 25 hooks. Upon disengagement from either hook, the elastic devices return the platform to a central position with first an overshoot and then a succession of damped oscillations. Most action is along the left-right axis (as viewed from the front); but, there is also some forward to back action adding to the effectiveness of the device when a watch rests in different positions in the cup. In the present embodiment the bolt 27 extends below the nut 29 up to 2 centimeters to accept the spring on that one corner. One could separately attach spring and hooks. As seen in FIG. 4, springs 15 are set in wells 19 in the base of the vibrating platform 91.

Referring now to FIG. 4, a method for attachment of elastic devices to platform 91 is shown. By insetting the springs 15 into a well 19 on each corner of the platform, pins 30 can be inserted from the sides to hold the springs in place. Such a method facilitates assembly and disassembly for repair and maintenance. More permanent methods include cementing springs 15 in place. It is important that whatever means of attachment is used to attach springs 15 to base 16 and to the platform 91, that motion of the platform is not substantially inhibited. Non-metallic elastic devices may be used such as thick sections of foam rubber or the like.

Referring now to FIG. 5, a side view is provided of the motor 20 and apparatus 23 on the motor shaft. This view shows a coupling to be a slip fit (and attached with set screw 231 or other appropriate means) shaft over a motor shaft 201 which in turn is part of a disk 31 of substantially larger diameter. On the outer perimeter of the disk 31 is attached pin 28. This may be in the form of a rod threaded into the disk, a bolt through the disk secured by a nut (as depicted) 232, a welded rod (if the disk is metal), or other such form of connection. In the present embodiment, a threaded rod 28 is screwed into a tapped hole 233 on the perimeter of the disk and doubly secured with a nut 232. Preferred characteristics of the rod 28 are that it be of smooth, low friction surface such as a polished metal or plastic. Plastic would be less noisy for products used in the home.

Motor 20 is wired through an On-Off switch 32 and a plug jack 21 which accepts a power plug 33. A power indicating light could be added.

Figure 6:
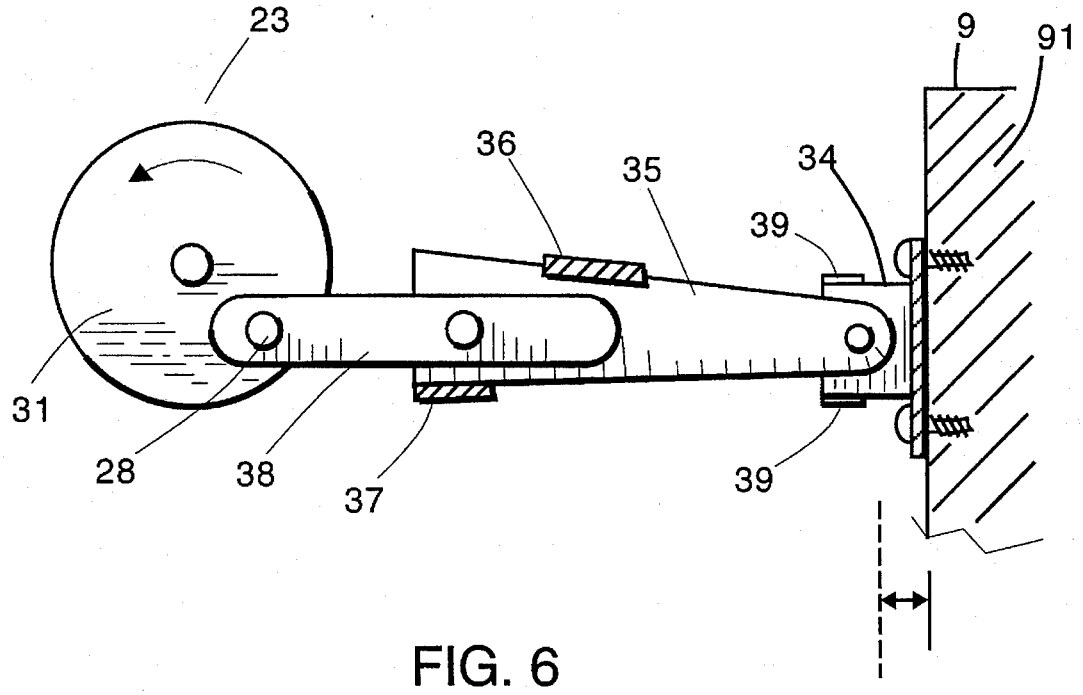
FIGS. 6 and 7 show two views of an alternate coupling mechanism to that of FIG. 3.
Figure 7:
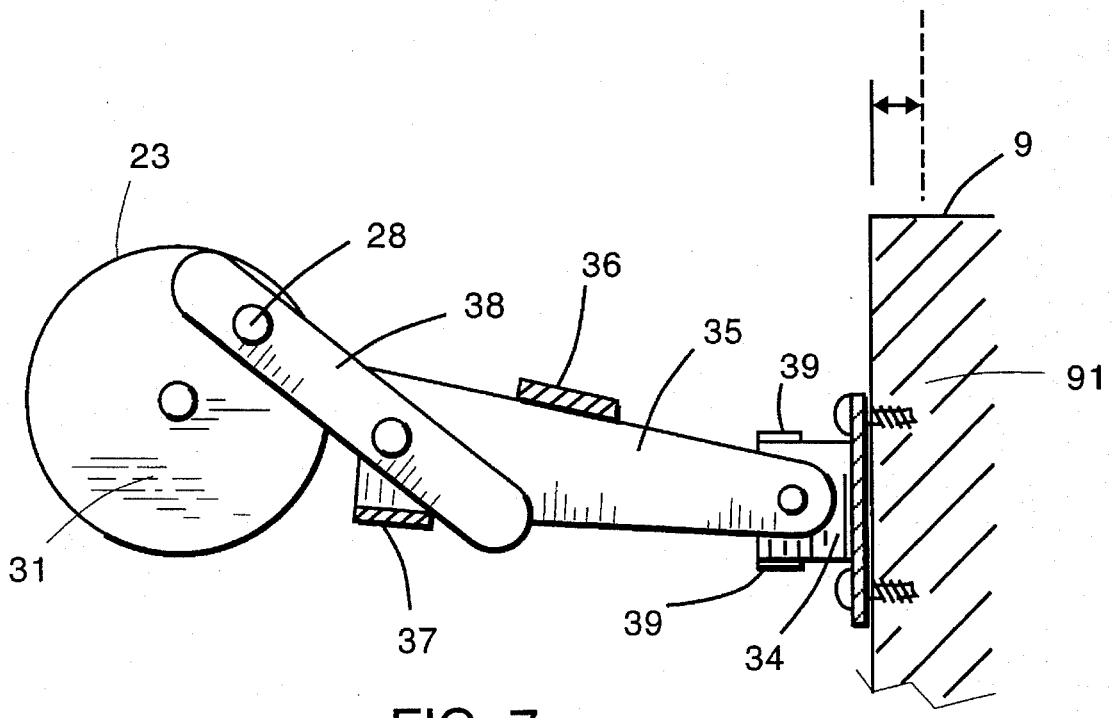

Referring now to FIG. 6 and FIG. 7, an alternate mechanism for providing coupling/decoupling of drive unit 23 to the holding device 9 is illustrated. It has three parts, a mounting bracket 34 which attaches to the platform 91; a plate 35 with constraining tabs 36 and 37; and a connecting piece 38 attached to pin 28 on disk 31. The constraining tabs on plate 35 are arranged such that as the connecting lever 38 is turned by the rotating disk 31, the linkage is rigid for part of the cycle, and then breaks away for another part of the cycle during which period the elastic devices return the platform 91 to an unperturbed position (with some bounce and damped oscillations as in the preceding mechanism).

The mounting bracket 34 is provided with tabs 39 which constrain the arc which plate 35 may make. The combination of pivot points and constraints makes an intermittent coupling system.

FIG. 6 shows the device in a push mode with the two piece arm 38 and 35 in a fixed extended mode. FIG. 7 shows the device in a release mode where the platform 91 travels through the central rest position and beyond. As disk 31 continues to turn, slack is taken up and platform 91 is pulled to the left of center line. A full cycle takes platform 91 through right push, then abrupt release then left pull. It is a different pattern from that created by the mechanism of FIG. 3; but is illustrative of other approaches for creating a snapping or accented action on the holding device.

Figure 8A:
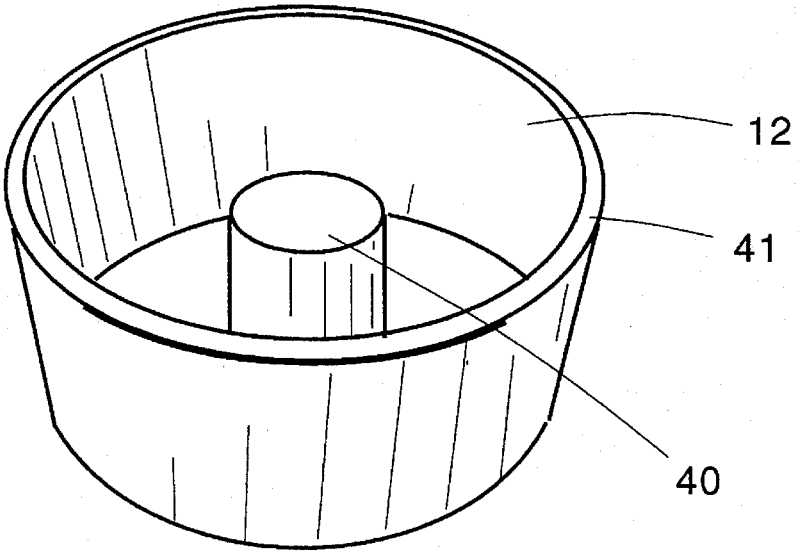
FIG. 8*a* is a detailed view of one form of a holding device that automatically positions the watch as in FIG. 1.

Referring now to FIG. 8*a*, the containers or cup(s) 12 into which the article is placed to be subject to the accented motion (such as a self-winding watch) is fashioned in such a way as to constrain the positions in which the article may be seated. In particular the watch cannot be placed face down or face up; rather, it needs to be perpendicular to the central axis of the cup. This may be accomplished by providing a spindle 40 in the center of the cup 12. The spindle may be cylindrical or conical in shape as long as it prevents placing the watch face down or up, as the watch band will encircle the central spindle 40. Thus, the height of spindle 40 should approximate at least the width of a watch band.

Other features of the container 12 in the holding device are: sloping sides to easily and snugly fit into the holes 92 provided on the platform 91; and, a lip 41 around the top edge to prevent the container(s) 12 from slipping too far into those holes. It is expected the containers 12 would be molded out of plastic in which case the inner spindle would have sides sloping out towards the bottom to facilitate mold release. Other material and/or processes may be used (such as spun metal) which would dictate minor design changes obvious to those skilled in such matters.

Figure 8B:
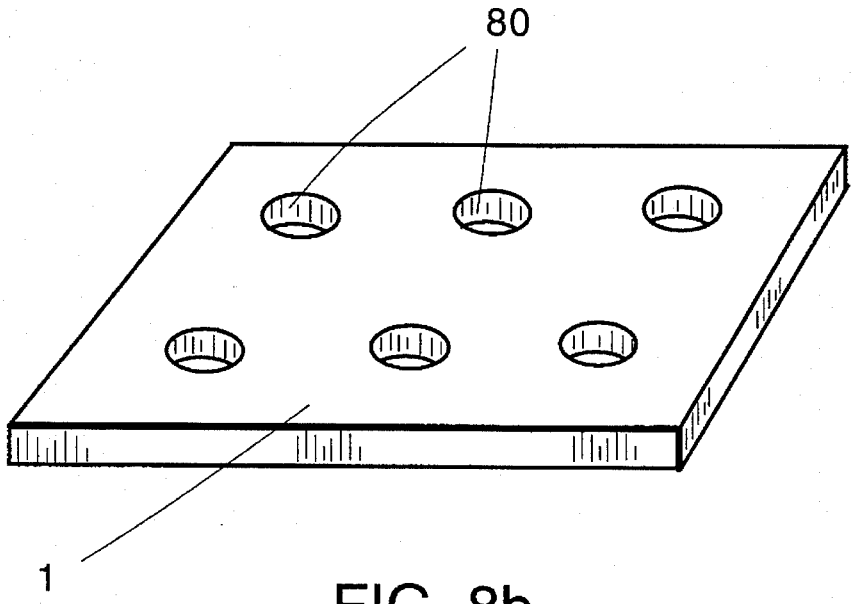
FIG. 8*b* is a view of an alternate form of a holding device wherein the container and platform are integral.

In FIG. 8*b*, the container 12 of FIG. 8*a* appears as a dimple 80 in the platform 91 as an integral piece using injection molding procedures or thermoforms. The size and shape of such dimples may be tailored to accommodate motion sensitive parts other than watches.

Our test results show that a steady rotation speed as presented in the referenced patents is not adequate simulation of the normal wrist action and does not represent the ideal motion for activating the winding mechanism which alternately accelerates and decelerates. Further, devices with rigid orientation, whether orthogonal or parallel to the presumed watch internal mechanism, are limiting in that the user must be aware of preferred orientation for each type of watch and mount them accordingly. For acceptance, consumers should not be expected to make adjustments for different watch internal mechanisms. The foregoing apparatus provides the variety of motions necessary for sustaining a wound-up state of self-winding watches.

Some alternate approaches which embody the same concept of accented motion using a loosely coupled eccentric means are illustrated in FIG. 9*a*–9*c*. In FIG. 9*a* a single elastic device 101 (in this instance a spring) forms a pedestal which has a base 100 and a top part 102 which serves as a container for a watch or the like. The container 102 may incorporate an orienting spindle 103 in it. The container 102 is directly subjected to alternate perturbations by means of a cam 104 which is attached to a rotating shaft.

In FIG. 9*b*, the pedestal is again formed of at least one elastic device 101 mounted on base 100 and supporting a top piece 105. Top piece 105 in this instance may be a plate with various holding mechanisms attached or may be a plate with integral shapes to secure and/or orient motion-sensitive devices. A cam 104 provides alternate displacement. In another instance the holding device 105 may be a sheet with dimples to accept very small parts (as electronic circuit elements) and include a covering piece 106.

In FIG. 9*c*, the pedestal is similar to that in FIG. 9*a* or FIG. 9*b* except that the elastic device 107 is formed of a foam rubber block, or a length of flexible and elastic material.

Devices other than watches to be tested in this vibrator invention may have other requirements for orientation in which case the holding device 9 of FIG. 1 or holding piece 105 of FIG. 9*b* and FIG. 9*c* may be comprised of a flat sheet of material to which are attached clips or elastic holders appropriate for the part to be held. Other configurations of the holding device would be obvious given a particular device or instrument to be tested.

What is claimed is:

1. An apparatus for producing accented vibrations to an object comprising:

means for holding said object means for elastically suspending said holding means;

means for periodically displacing said suspending means; and means for periodically engaging and disengaging said displacement means from said suspending means, such that said elastically suspending means allows motion having more than one degree of freedom.

2. The apparatus of claim 1 wherein said suspension means further comprises at least one spring.

3. The apparatus of claim 1 wherein said suspension means further comprises an elastically suspended platform.

4. The apparatus of claim 1 wherein said holding means further comprises at least one container for said object.

5. The apparatus of claim 4 wherein said container is provided with a spindle.

6. The apparatus of claim 4 wherein said container is provided with a cover.

7. The apparatus of claim 1 further comprising:

a motor having an off-center engaging pin.

8. The apparatus of claim 7 wherein said means of engaging and disengaging further comprises:

at least one piece located on said suspension means, said piece being shaped to catch said engaging pin.

9. The apparatus of claim 7 wherein said means of engaging and disengaging further comprises:

at least one piece located on said suspension means, said piece being shaped to be pushed and then released by said pin.

10. The apparatus of claim 1 wherein said means of engaging and disengaging further comprises:

at least one cam piece turned by a motor.

11. The apparatus of claims 7 wherein said motor is an electric motor.

12. The apparatus of claim 4 wherein said container is integral with an elastically suspended platform which further comprises said elastically suspending and holding means.

13. The apparatus of claim 1 further comprising:

an enclosure.

14. The apparatus of claim 13 wherein enclosure further comprises:

compliant feet; and a lining.

15. The apparatus of claim 13 wherein motion of said holding means is constrained by channels on said enclosure.

16. The apparatus of claim 13 wherein said enclosure further comprises:

a hinged cover.

17. The apparatus of claim 1 wherein the holding device is chosen from the group consisting of clips, hooks, and mandrels.

18. The apparatus of claim 13 wherein said enclosure further comprises:

a compartment for storing items.

19. An apparatus for producing accented vibrations to an object comprising:

means for holding said object means for elastically suspending said holding means;

means for periodically displacing said suspending means; and means for periodically engaging and disengaging said displacement means from said suspending means wherein said engaging and disengaging means further comprises a jointed arm which alternately locks up or breaks free and bends.

20. The apparatus of claim 19 wherein the said arm further comprises:

three components linked together with pins around which rotation may occur; and means for constraining the extent of rotation as a function of said position of components relative to one another.

* * * * *